US006827147B2

(12) United States Patent
Dallas

(10) Patent No.: US 6,827,147 B2
(45) Date of Patent: Dec. 7, 2004

(54) RECIPROCATING LUBRICATOR

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 0 days.

(21) Appl. No.: 10/162,803

(22) Filed: Jun. 3, 2002

(65) Prior Publication Data

US 2003/0221844 A1 Dec. 4, 2003

(51) Int. Cl.[7] ..... E21B 19/00; E21B 43/01

(52) U.S. Cl. ..... 166/379; 166/77.4; 166/85.4; 166/360; 166/368

(58) Field of Search ..... 166/368, 360, 166/378, 379, 381, 382, 386, 387, 75.11, 75.13, 77.1, 77.4, 85.1–85.5, 97.1

(56) References Cited

U.S. PATENT DOCUMENTS

| | | | | | |
|---|---|---|---|---|---|
| 3,924,686 | A | * | 12/1975 | Arnold | 166/385 |
| 4,241,786 | A | | 12/1980 | Bullen | 166/77 |
| 4,479,537 | A | * | 10/1984 | Reed | 166/77.4 |
| 4,632,183 | A | | 12/1986 | McLeod | 166/77 |
| 4,681,168 | A | | 7/1987 | Kisling, III | 166/381 |
| 4,867,243 | A | * | 9/1989 | Garner et al. | 166/379 |
| 5,540,282 | A | | 7/1996 | Dallas | 166/379 |
| 5,568,837 | A | * | 10/1996 | Funk | 166/383 |
| 5,615,739 | A | | 4/1997 | Dallas | 166/306 |
| 5,785,121 | A | | 7/1998 | Dallas | 166/90.1 |
| 5,819,851 | A | | 10/1998 | Dallas | 166/308 |
| 5,893,417 | A | * | 4/1999 | Pizzolato | 166/377 |
| 5,988,274 | A | * | 11/1999 | Funk | 166/77.4 |
| 5,992,516 | A | * | 11/1999 | Palynchuk et al. | 166/77.2 |
| 6,009,941 | A | | 1/2000 | Haynes | 166/72 |
| 6,015,014 | A | | 1/2000 | Macleod et al. | 166/374 |
| 6,142,233 | A | * | 11/2000 | Wilkins | 166/339 |
| 6,145,596 | A | * | 11/2000 | Dallas | 166/379 |
| 6,179,053 | B1 | * | 1/2001 | Dallas | 166/77.51 |
| 6,209,633 | B1 | | 4/2001 | Haynes | 166/72 |
| 6,220,363 | B1 | | 4/2001 | Dallas | 166/382 |
| 6,234,253 | B1 | | 5/2001 | Dallas | 166/377 |
| 6,289,993 | B1 | | 9/2001 | Dallas | 166/386 |
| 6,328,111 | B1 | * | 12/2001 | Bearden et al. | 166/381 |
| 6,364,024 | B1 | | 4/2002 | Dallas | 166/379 |
| 6,412,560 | B1 | * | 7/2002 | Bernat | 166/301 |
| 6,510,900 | B2 | | 1/2003 | Dallas | 166/384 |

OTHER PUBLICATIONS

Patent application Ser. No. 09/537,629 entitled "Blowout Preventer Protector and Method of Using Same," filed Mar. 29, 2000.

Patent application Ser. No. 09/791,980 entitled "Method and Apparatus for Inserting a Tubing Hanger Into a Live Well," filed Feb. 23, 2001.

Patent application Ser. No. 09/998,953 entitled "Spool for Pressure Containment Used in Rigless Well Completion, Re–Completion, Servicing or Workover," filed Nov. 15, 2001.

Patent application Ser. No. 10/034,032 entitled "Slip Spool and Method of Using Same," filed Dec. 19, 2001.

Patent application Ser. No. 10/050,024 entitled "Well Stimulation Tool and Method of Using Same," filed Jan. 15, 2002.

Patent application Ser. No. 10/162,773 entitled "Well Stimulation Tool and Method of Using Same," filed Jun. 4, 2002.

* cited by examiner

*Primary Examiner*—David Bagnell
*Assistant Examiner*—Jennifer H Gay
(74) *Attorney, Agent, or Firm*—Nelson Mullins Riley & Scarborough, LLP

(57) ABSTRACT

A reciprocating lubricator includes a lubricator base, a lubricator tube connected at the top to a lubricator head and inserted through a packing in the lubricator base to provide a sealable chamber adapted to accommodate a downhole tool to be inserted into a wellbore against well fluid pressure. The chamber in the lubricator tube is sealed using equipment mounted to the lubricator head. Injectors interconnecting the lubricator base and the lubricator head reciprocate the lubricator tube through the lubricator base. When a downhole tool is inserted into the wellbore, the lubricator head rests against the lubricator base to provide a low, safe and stable position for operation of the equipment mounted to the top of the lubricator head.

15 Claims, 6 Drawing Sheets

RECIPROCATING LUBRICATOR

TECHNICAL FIELD

The present invention relates to a method and apparatus for inserting downhole tools into, and withdrawing them from, a pressurized wellbore and, in particular, to a lubricator that can be reciprocated into and out of a wellbore when it is mounted to a wellhead.

BACKGROUND OF THE INVENTION

Inserting downhole tools through wellheads into pressurized wellbores has been practiced for decades, and is essential for certain phases of well drilling, well completion and well servicing. The process of inserting the downhole tools is generally accomplished using a tool commonly referred to as "lubricator". A lubricator is one or more tubular members that form a sealed chamber around a downhole tool. The lubricator is attached to a pressure containment spool, such as a valve or blowout preventer at the top of the wellhead. At an upper end of the lubricator, sealing equipment such as a grease injector and/or a stuffing box seals the top of the lubricator, while permitting the downhole tool to be suspended by a downhole tool insertion string, a wireline for example, that extends through the sealing equipment. Thus, a sealed chamber is provided within the lubricator above a closure mechanism of the pressure containment spool. The sealed chamber houses the downhole tool and contains well pressure while the downhole tool is inserted into the wellbore. Pressure between the wellbore and the lubricator is equalized using a high-pressure hose connected between a bypass valve located below the pressure containment spool and a bleed port on or above the lubricator. The closure mechanism of the pressure containment spool is then opened, allowing access to the wellbore. The downhole tool is lowered into the wellbore by manipulating the downhole tool insertion string.

The downhole tool is extracted from the wellbore by drawing it up within the chamber in the lubricator, closing the pressure containment spool, venting the lubricator by opening the bleed port, and removing the lubricator and the downhole tool from the wellhead. This procedure works well for short downhole tools, and has been practiced for many years. However, some downhole tools are very long. For example, logging tools for monitoring the conditions within a production well are generally elongated tubular assemblies. Consequently, a lubricator for providing a sealed chamber to contain the downhole tool extends high above the wellhead. If a long lubricator is required, equipment mounted to the upper end of the lubricator is located even higher above the wellhead, making it difficult to access, awkward to operate, and placing considerable mechanical stress on the lubricator and the wellhead.

Efforts have been made to improve the method and apparatus for lubricating downhole tools into a wellbore. An example of such efforts is described in U.S. Pat. No. 4,681,168, entitled METHOD AND APPARATUS FOR RUNNING LONG TOOLS INTO AND OUT OF A PRESSURIZED ENCLOSURE, which issued to Kisling, III on Jul. 21, 1987. Kisling describes a method and apparatus for running long downhole tools into and out of pressurized enclosures including a tool stop assembled on an access pressure lock of the enclosure. The tool stop cooperates with a segmented tool string to allow sequential assembly, insertion, withdrawal and disassembly of the tool string. The tool string is made up of a number of tool segments interconnected by coupler/spacer members of a smaller diameter than the tool sections, and of a shorter length. A tool catcher acts upon the thinner sections of the coupler/spacer members to fixedly hold the tool string in place for subsequent assembly/disassembly without allowing any significant pressure change inside the enclosure. The lubricator used in Kisling's method is therefore relatively shorter than the entire length of the assembled tool string.

Nevertheless, Kisling's method and apparatus are limited to applications for lubricating tools that may be divided into tool segments. Tools used in well drilling, well completion and servicing are of several varieties, and not many of them can be lubricated through wellheads into wellbores using the method and apparatus described by Kisling. For example, a deep drilling motor, which is about ten feet long and is driven using a coil tubing string, cannot be lubricated into the wellbore by using Kisling's method and apparatus. In order to insert the deep drilling motor and the coil tubing string, a coil tubing injector must be installed on the top of the lubricator. Such a lubricator system with the injector mounted to the top is positioned high above the wellhead and is consequently difficult to operate.

There therefore exists a need for an improved lubricator that addresses these problems and is adaptable for use with various downhole tools used in well drilling, well completion and well servicing operations.

SUMMARY OF THE INVENTION

It is therefore an object of the invention to provide a lubricator through which a lubricator tube can be reciprocated, in order to lower equipment mounted to the top of a lubricator tube to promote safe and convenient operation of such equipment and reduce stress on the lubricator and the wellhead.

In accordance with one aspect of the invention, a reciprocating lubricator provides a sealed chamber for accommodating a downhole tool to be inserted into a wellbore closed by a pressure containment spool. The reciprocating lubricator comprises a lubricator tube, a lubricator base and a lubricator head. The lubricator base is adapted to be mounted in a fluid-tight seal to a top of the pressure containment spool, and includes an axial passage for sealingly receiving the lubricator tube. The lubricator head has an axial passage and is sealingly connected to a top end of the lubricator tube, in order to provide a base for supporting other equipment to be mounted to the lubricator head. At least one lubricator injector is used to move the lubricator tube and the lubricator head from a first position in which the lubricator tube is positioned above a wellbore closure mechanism of the pressure containment spool, to a second position in which the lubricator tube extends down through the pressure containment spool in order to lower the lubricator head.

The reciprocating lubricator preferably comprises a lock mechanism for locking the lubricator tube and the lubricator head in the second position. The lubricator head preferably includes an adapter affixed to the top thereof for sealingly connecting the other equipment to the top of the lubricator head. The axial passage extends through the lubricator head and the adapter to permit a tool insertion string to pass therethrough for suspending the downhole tool accommodated in the chamber. The other equipment provides a seal around the tool insertion string while the downhole tool is lowered into the wellbore. The seal may be provided, for example, by a blowout preventer, a grease injection tube or a stuffing box, depending on the type of downhole tools and the type of tool insertion string required for a particular job.

In accordance with another aspect of the present invention, a method is provided for inserting a downhole tool into a live wellbore closed by a pressure containment spool. The method comprises mounting a reciprocating lubricator with the downhole tool accommodated in a sealed chamber of the lubricator to the top of the pressure containment spool. After the mounting of the lubricator with the downhole tool accommodated in the sealed chamber, the wellbore closure mechanism of the pressure containment spool is opened to allow access to the wellbore so that the sealed chamber can communicate with the wellbore. The lubricator tube with the downhole tool accommodated in the sealed chamber is then inserted downwards into the pressure containment spool, in order to lower the lubricator head. Thus, any equipment mounted on the top of the lubricator head is lowered together with the lubricator head.

After the lubricator head is lowered, the downhole tool insertion string is manipulated to lower the downhole tool to a required position in the wellbore.

The reciprocating lubricator can be used to insert various downhole tools, or strings of downhole tools, into wellbores. The reciprocating lubricator is particularly advantageous for coil tubing applications, because the reciprocating lubricator lowers the position of the coil tubing injector, which improves safety and relieves stress on the wellhead.

Other advantages and features of the present invention will be better understood with reference to preferred embodiments of the present invention described hereinafter.

BRIEF DESCRIPTION OF THE DRAWINGS

Having thus generally described the nature of the present invention, reference will now be made to the accompanying drawings, showing by way of illustration the preferred embodiments thereof, in which.

DETAILED DESCRIPTION OF THE PREFERRED EMBODIMENTS

The invention provides a reciprocating lubricator for inserting downhole tools into, or extracting the downhole tools from, a pressurized wellbore. The lubricator reciprocates through a base plate from a first position in which a lubricator tube that houses the downhole tool(s) is above a pressure containment spool at a top of a wellhead, to a second position in which the lubricator tube is inserted down through the pressure containment spool. Consequently, in the second position a top of the lubricator rests against a top of the wellhead. This facilitates many downhole operations, especially downhole operations using coil tubing, because equipment mounted to a top of the lubricator is stable and accessible when the lubricator is in the second position.

Figure 1:
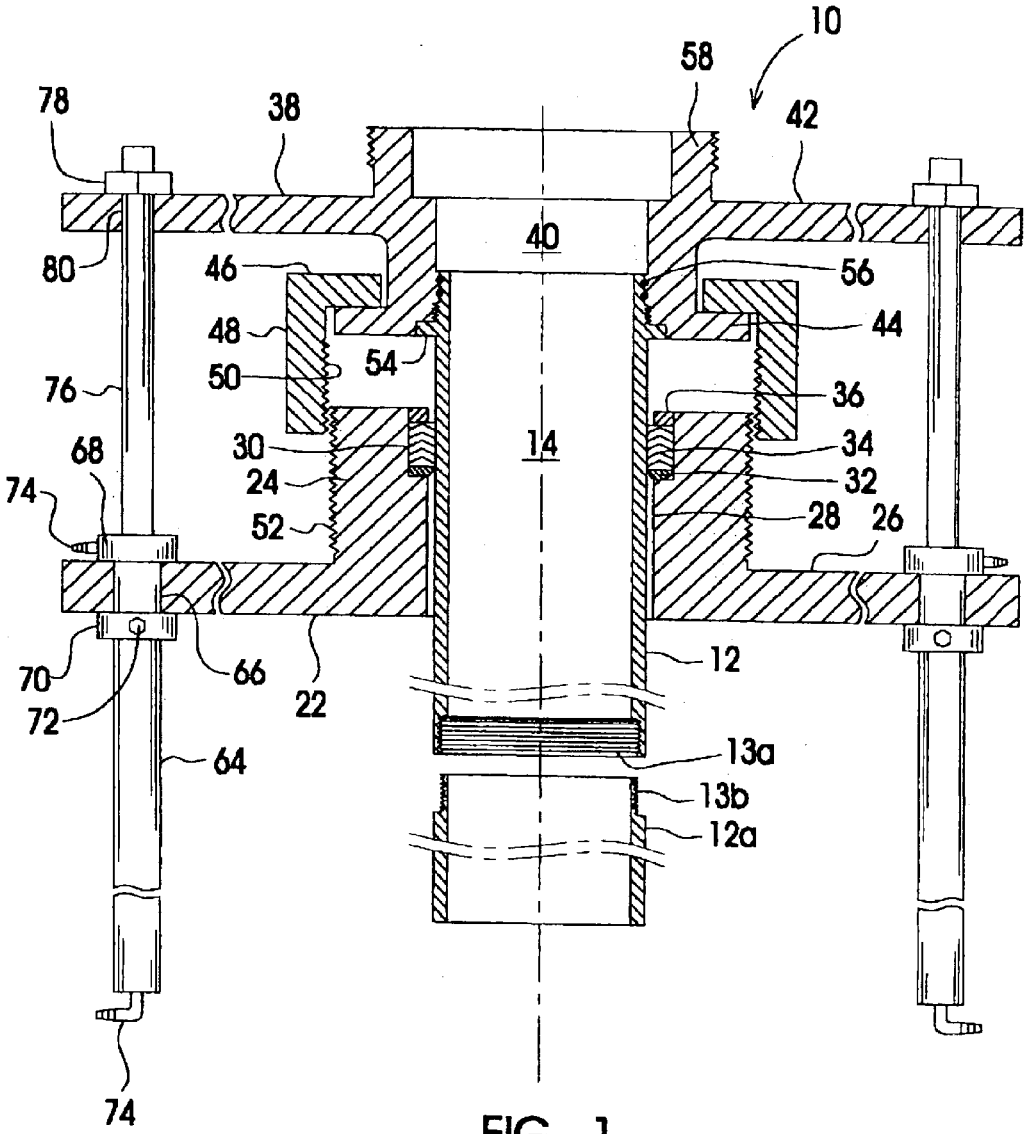
FIG. 1 is a cross-sectional view of a lubricator in accordance with one embodiment of the present invention.
Figure 2:
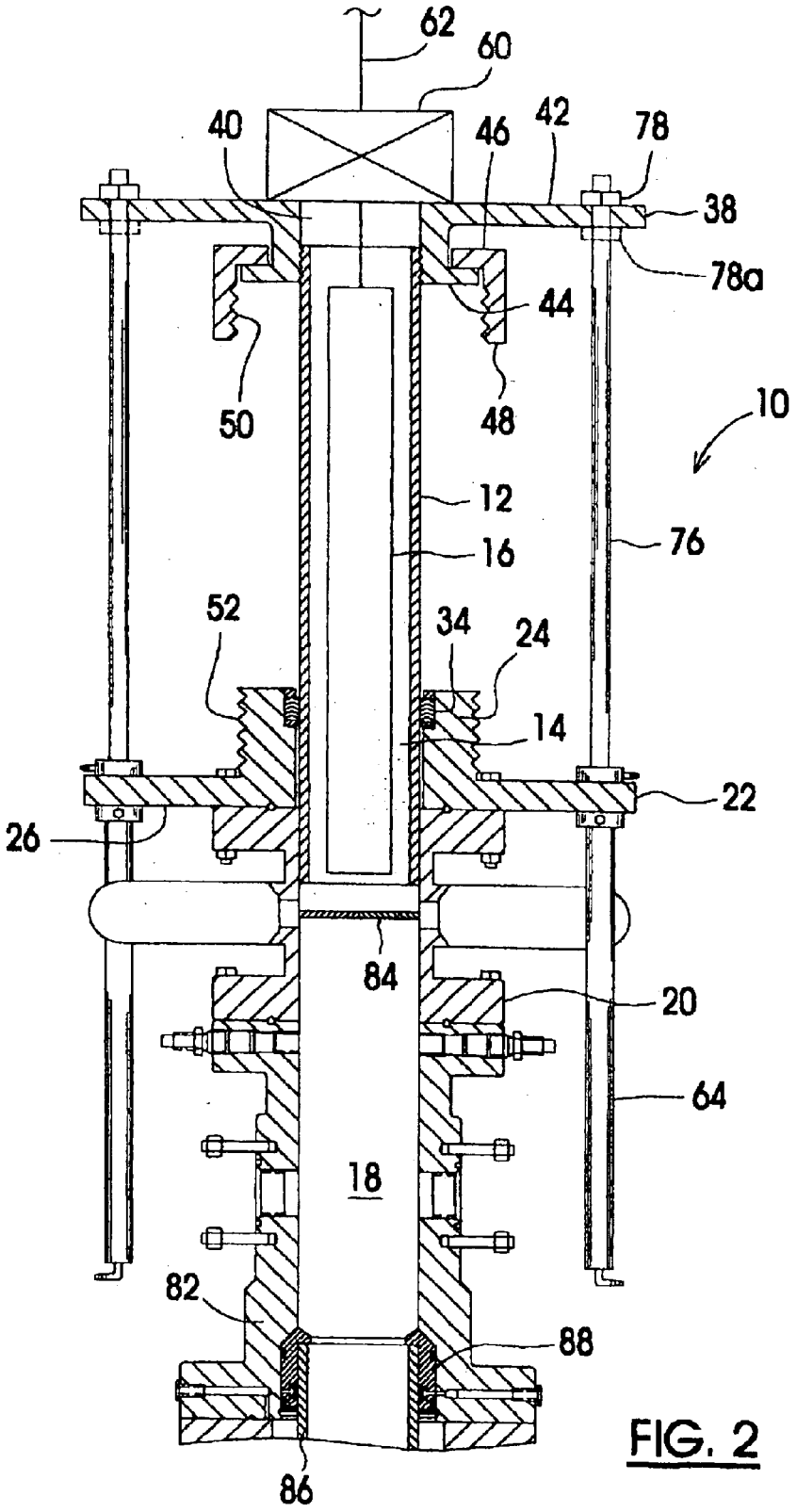
FIG. 2 is a schematic cross-sectional view of the lubricator shown in FIG. 1 mounted to a wellhead, showing the lubricator in a first position.
Figure 3:
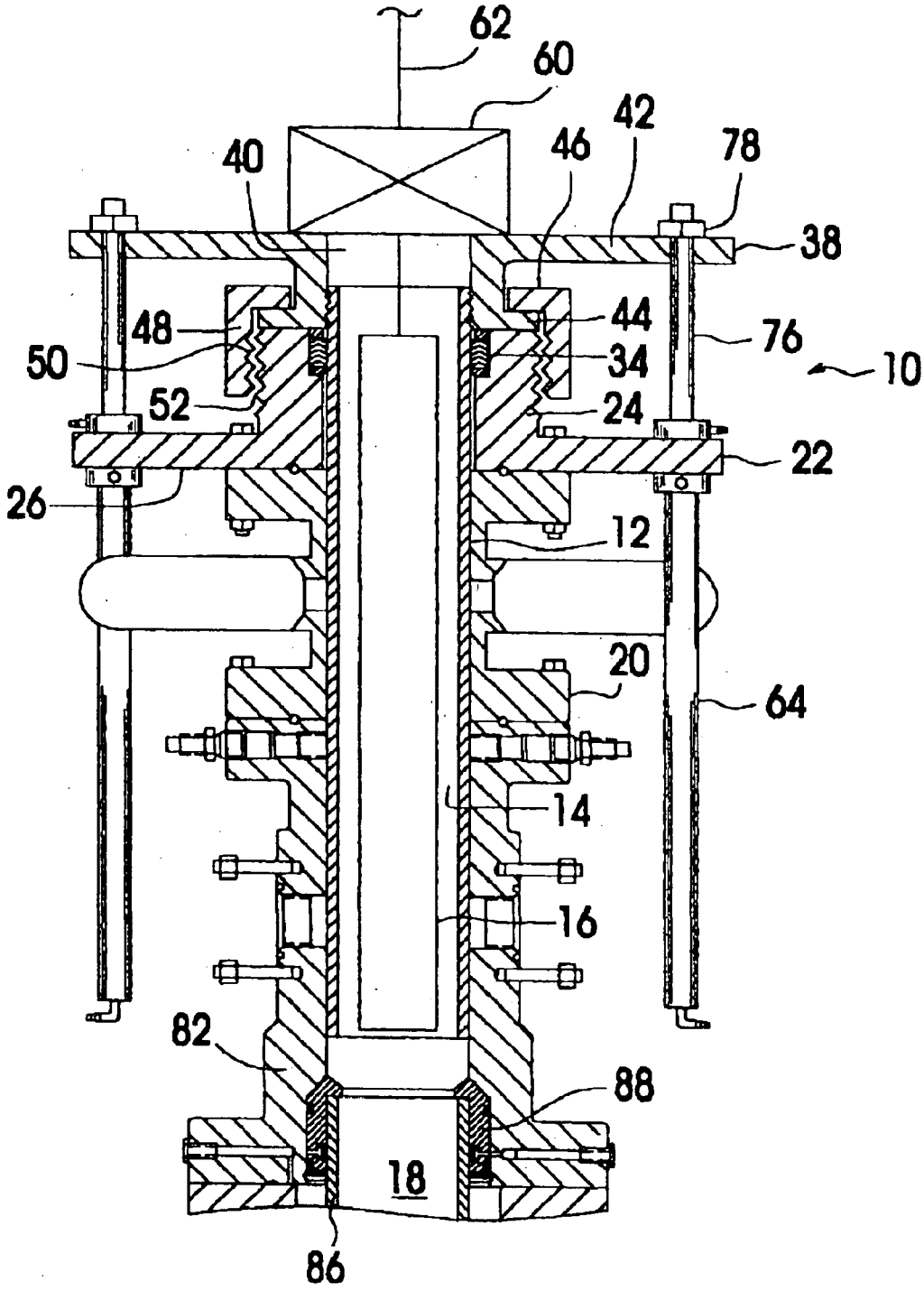
FIG. 3 is a schematic cross-sectional view of the lubricator and the wellhead shown in FIG. 2, with the lubricator in a second position.

As shown in FIGS. 1–3, a reciprocating lubricator 10 includes a lubricator tube 12 for providing a sealable chamber 14 to accommodate a downhole tool(s) 16 to be inserted into a wellbore 18. The wellbore 18 is closed by a pressure containment spool, such as a gate valve or a blowout preventer (BOP). In this example, the pressure containment spool is a BOP 20. The lubricator tube 12 may include one or more tube extensions 12*a* (only one is shown in FIG. 1) so that the chamber 14 defined by the lubricator tube 12 can be extended to a length required for various downhole tools, or strings of downhole tools, as required for any given application. The lubricator tube 12 and the extensions 12*a* are interconnected, for example, by respective box threads 13*a* and pin threads 13*b*, as shown in FIG. 1. A fluid seal (not shown) is provided between the lubricator tube extensions 12*a*, to prevent fluid leakage under pressure. The fluid seal may be one or more O-rings, for example, which are well known in the art.

A lubricator base 22 is mounted in a fluid-tight seal to the top of the BOP 20. The lubricator base 22 includes a cylindrical throat 24, a base plate 26 and an axial passage 28 that extends through the cylindrical throat 24 and the base plate 26.

The axial passage 28 includes a radially recessed region 30 for receiving a steel spacer 32 and packing rings 34, preferably constructed of brass, rubber, and/or fabric. The steel spacer 32 and packing rings 34 define a passage of a same diameter as the periphery of the lubricator tube 12. The steel spacer 32 and packing rings 34 are removable and may be interchanged to accommodate different sizes of the lubricator tube 12. The steel spacer 32 and packing rings 34 are retained in the axial passage 28 by a hollow retainer nut 36. The combination of the steel spacer 32, packing rings 34 and the hollow retainer nut 36 provides a fluid seal to prevent well fluid from escaping to atmosphere between the exterior of the lubricator tube 12 and the interior of the BOP 20 when the lubricator base 22 is mounted in a fluid tight seal to the top of the BOP 20.

The reciprocating lubricator 10 further includes a lubricator head 38 which is, for example, an annular flange having an axial passage 40, a top flange 42 and a bottom flange 44. The bottom flange 44 retains a top wall 46 of a lockdown nut 48. The lockdown nut 48 secures the lubricator head 38 from movement with respect to the lubricator base 22 when a box thread 50 of the lockdown nut 48 engages a pin thread 52 on the cylindrical throat 24 of the lubricator base 22. The lubricator head 38 is connected to the top end of the lubricator tube 12, which is secured by threaded engagement within a lower portion of the axial passage 40. A flange 54 affixed to and surrounding the lubricator tube 12 abuts a recess in the bottom of the bottom flange 44 of the lubricator head 38. O-ring seals 56, or the like, are provided between the lubricator tube 12 and the axial passage 40, to provide a high-pressure fluid seal.

The top flange 42 is configured to facilitate connection of equipment 60 that may be mounted to a top of the lubricator 10. A connector 58, for example a Bowen connector, on the top flange 42 sealingly connects the equipment 60 to the lubricator 10. The axial passage 40 of the lubricator head 38 extends through the connector 58 to provide a top section of the sealable chamber 14, and provides a passage permitting a downhole tool insertion string 62 to be inserted into the chamber 14 for suspending the downhole tool 16 accommodated in the chamber 14, which will be further described below.

The lubricator head 38 with its top flange 42, bottom flange 44, connector 58 and the lockdown nut 48 are illustrated in FIG. 1 as an integral unit, assembled for example, by welding or the like. However, persons skilled in the art will understand that either one of the lubricator head 38 and the lockdown nut 48 can be constructed to permit disassembly in order to enable the lubricator head 38 or the lockdown nut 48 to be independently replaced.

At least one lubricator injector 64 is provided for reciprocating the lubricator tube 12 between the first and second positions. The lubricator injectors 64 may be screw jacks, ball jacks or, as shown in this example, a pair of hydraulic cylinders 64, secured to the lubricator base 22 at opposite sides thereof. The hydraulic cylinders 64 are substantially vertically oriented and are received in respective bores or notches 66 located at the opposite sides of the base plate 26. A cylinder cap 68 having a larger diameter than the hydraulic cylinder 64, serves as a stop to restrain downward movement of the hydraulic cylinder 64 relative to the lubricator base 22. A lock ring 70 secured to the hydraulic cylinder 64 by set screws 72, restrains the hydraulic cylinder 64 from upward movement relative to the lubricator base 22. The set screws 72 engage an annular groove (not shown) formed around the hydraulic cylinder 64 just below the bottom of the base plate 26. Hydraulic connectors 74 are provided at opposite ends of the hydraulic cylinders 64 to permit hydraulic fluid to be injected into or withdrawn from either end of the hydraulic cylinder 64 in order to reciprocate piston rods 76. The piston rod 76 of each hydraulic cylinder 64 is provided with a connecting nut 78 that threadingly engages the top end of the piston rod 76, which extends through a bore 80 in the top flange 42 of the lubricator head 38.

In order to provide a sufficient length of stroke, each hydraulic cylinder 64 is relatively long. The length of the hydraulic cylinder 64 is limited by the height of the wellhead. Consequently, the piston rods 76 may include detachable extension sections (not shown) so that the lubricator 10 can be moved over a distance longer than the length of the hydraulic cylinder 64, in several strokes using methods well known in the art. Alternatively, the hydraulic cylinders 64 may be two or three stage cylinders, which are known in the art to substantially increase (nearby double or triple) a length of the stroke. As a further alternative, a spacer spool (not shown) can be added between the top of the BOP 20 and the hydraulic cylinders 64. As yet a further alternative, one or more appropriately-sized extension sections 12*a* (FIG. 1) can be connected to a top of the connector 58 to elongate a top of the lubricator tube 12, in order to accommodate longer downhole tools.

FIGS. 2 and 3 illustrate a use of the lubricator 10 to insert the downhole tool 16, such as a logging tool supported by the downhole tool insertion string 62, which is a wireline in this example. The BOP 20 is mounted to the top of a tubing hanger spool 82, which contains a bit guide 88 for protecting the top end of the casing 86. Blind rams 84 of the BOP 20 are closed to seal the wellbore 18 (see FIG. 2). The lubricator base 22 is hoisted above the BOP 20, aligning therewith and is sealingly mounted to the top of the BOP 20. The two hydraulic cylinders 64 with their piston rods 76 retracted are then secured to the lubricator base 22. Alternatively, the two hydraulic cylinders can be secured to the lubricator base 22 prior to the installation of the lubricator base 22.

The lubricator tube 12, lubricator head 38 and the equipment 60, which can be a grease junction tube or stuffing box, can be assembled on the ground or on a work platform (not shown). The downhole tool 16 suspended by the wireline 62 that extends through the grease junction tube or stuffing box 60 is placed into the lubricator tube 12. The combination of the assembled lubricator tube 12, lubricator head 38 and the grease junction tube or stuffing box 60 with the downhole tool 16 accommodated within the lubricator tube 12, is hoisted by a service rig or boom truck (not shown) above the lubricator base 22, and the lubricator tube 12 is then aligned with the lubricator base 22.

After the lubricator tube 12 is aligned with the lubricator base 22, the combination of the assembled lubricator tube 12, lubricator head 38 and the grease junction tube or stuffing box 60 with the downhole tool 16 accommodated within the lubricator tube 12, is lowered in order to insert the lubricator tube 12 through the lubricator base 22 and into the BOP 20 until the bottom end of the lubricator tube 12 is positioned above the closed blind rams 84 of the BOP 20. The hydraulic cylinders 64 which have been connected to a hydraulic pump (not shown) are actuated to extend the respective piston rods 76 upwardly until the respective top ends thereof extend through the lubricator head 38 and are connected thereto by the connecting nuts 78, as shown in FIG. 2. In this position, the combination of the assembled lubricator tube 12, lubricator head 38 and the grease junction tube or stuffing box 60, is not supported by the hydraulic cylinders 64 and therefore the combination is still supported by the service rig, or boom truck. Additional connecting nuts 78*a* (shown with dashed lines) may be used to restrain the lubricator head 38 from movement in both directions with respect to the piston rods 76, such that the combination of the assembled lubricator tube 12, lubricator head 38 and grease junction tube or stuffing box 60 is supported by the hydraulic cylinders 64 when the hydraulic cylinders 64 are hydraulically locked.

After the lubricator tube 12 is inserted into the lubricator base 22, the packing rings 34 seal an annulus between the lubricator base 22 and the lubricator tube 12, while permitting the reciprocal movement of the lubricator tube 12. The grease junction tube or stuffing box 60 seals the top of the lubricator head 38, while permitting the wireline 62 to pass therethrough. Thus, the downhole tool 16 is contained within the sealed chamber 14. The well fluid pressure is then balanced between the wellbore 18 closed by the blind rams 84 of the BOP 20, and the sealed chamber 14, in a manner well known in the art.

As will be understood by those skilled in the art, the entire lubricator 10, with equipment 60, can alternatively be assembled on the ground and hoisted in one operation to a top of the BOP 20.

After the well fluid pressure is balanced, the blind rams 84 of the BOP 20 are opened to provide downhole access. The hydraulic cylinders 64 are actuated again to move the lubricator head 38 downwards against the well fluid pressure until the bottom flange 44 of the lubricator head 38 rests on the top of the cylindrical throat 24 of the lubricator base 22, the lockdown nut 48 is securely engaged with the box thread 52 of the cylindrical throat 24, as shown in FIG. 3. Thus, the total height is reduced, which reduces strain on the lubricator 10 and the wellhead, and creates safer and more convenient operating conditions with much improved stability.

When the downhole operations are completed and the downhole tool 16 is to be removed from the wellbore 18, the above-described procedure is reversed.

It should also be noted that in this embodiment the outer diameter of the lubricator tube 12 is greater than an inner diameter of the casing 86, so that the length of the lubricator tube 12 is limited by the height of the wellhead. When a longer lubricator tube is required to accommodate a downhole tool, or a string of downhole tools, having a longer length, the lubricator tube preferably has an outer diameter smaller than the inner diameter of the casing 86, so that it can be inserted into the casing.

Figure 4:
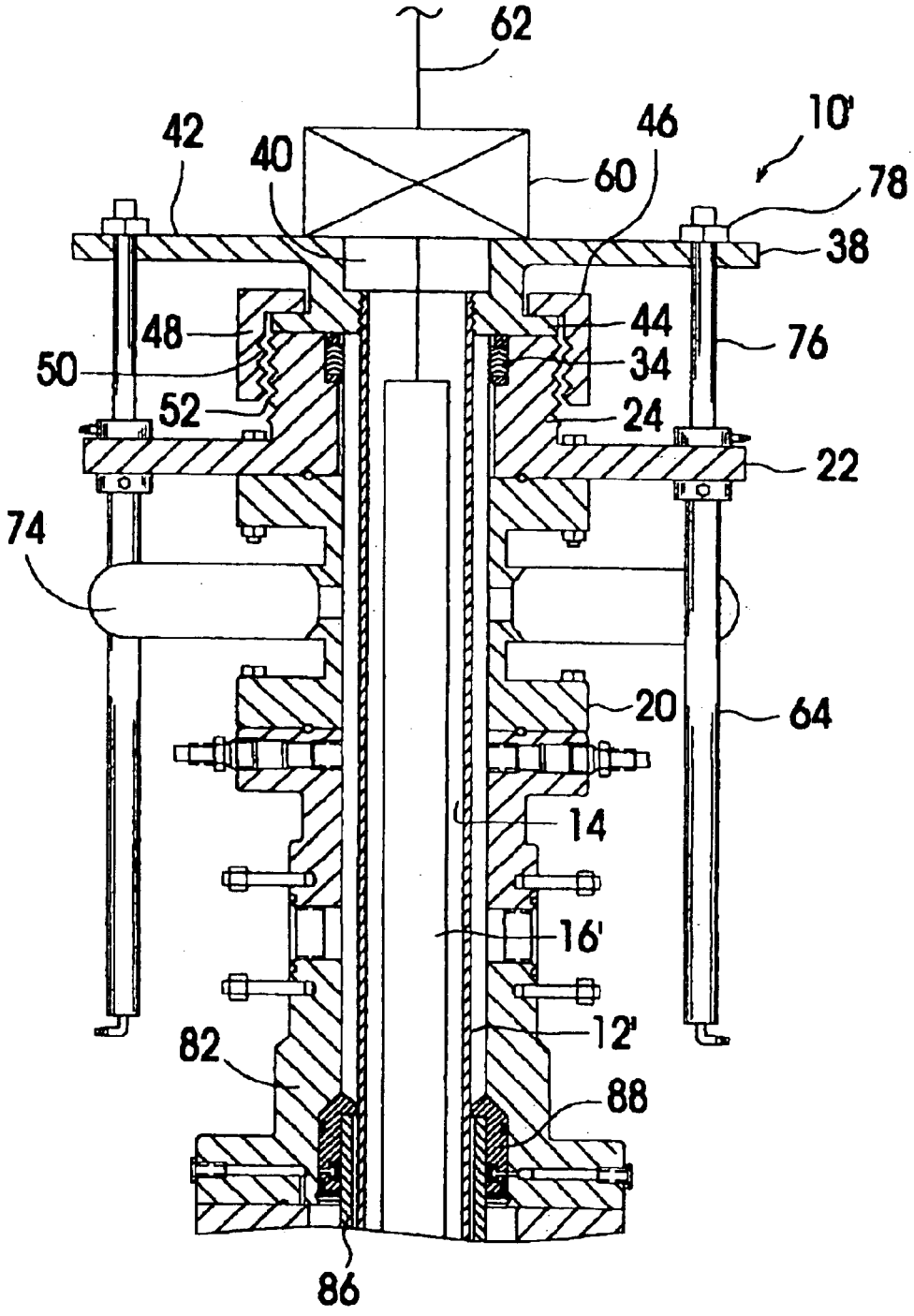
FIG. 4 is a cross-sectional view of another embodiment of the lubricator in accordance with the invention, mounted to a wellhead in the second position.

As illustrated in FIG. 4, a lubricator 10' in accordance with another embodiment of the invention has a lubricator tube 12' with an outer diameter smaller than the inner diameter of the casing 86. The lubricator tube 12' also has a length that is greater than the height of the wellhead. Thus, the lubricator tube 12' is adapted to accommodate a downhole tool, or tool string, 16' having a length greater than the height of the wellhead, and is inserted downwards into the casing 86 in order to permit the bottom flange 44 of the lubricator head 38 to rest on the top of the cylindrical throat 24 of the lubricator base 22. Other components of the lubricator 10' are identical to those of the lubricator 10 and are indicated by similar reference numerals. The lubricator 10' permits a tool string of any length to be safely lubricated into the wellbore 18.

Figure 5:
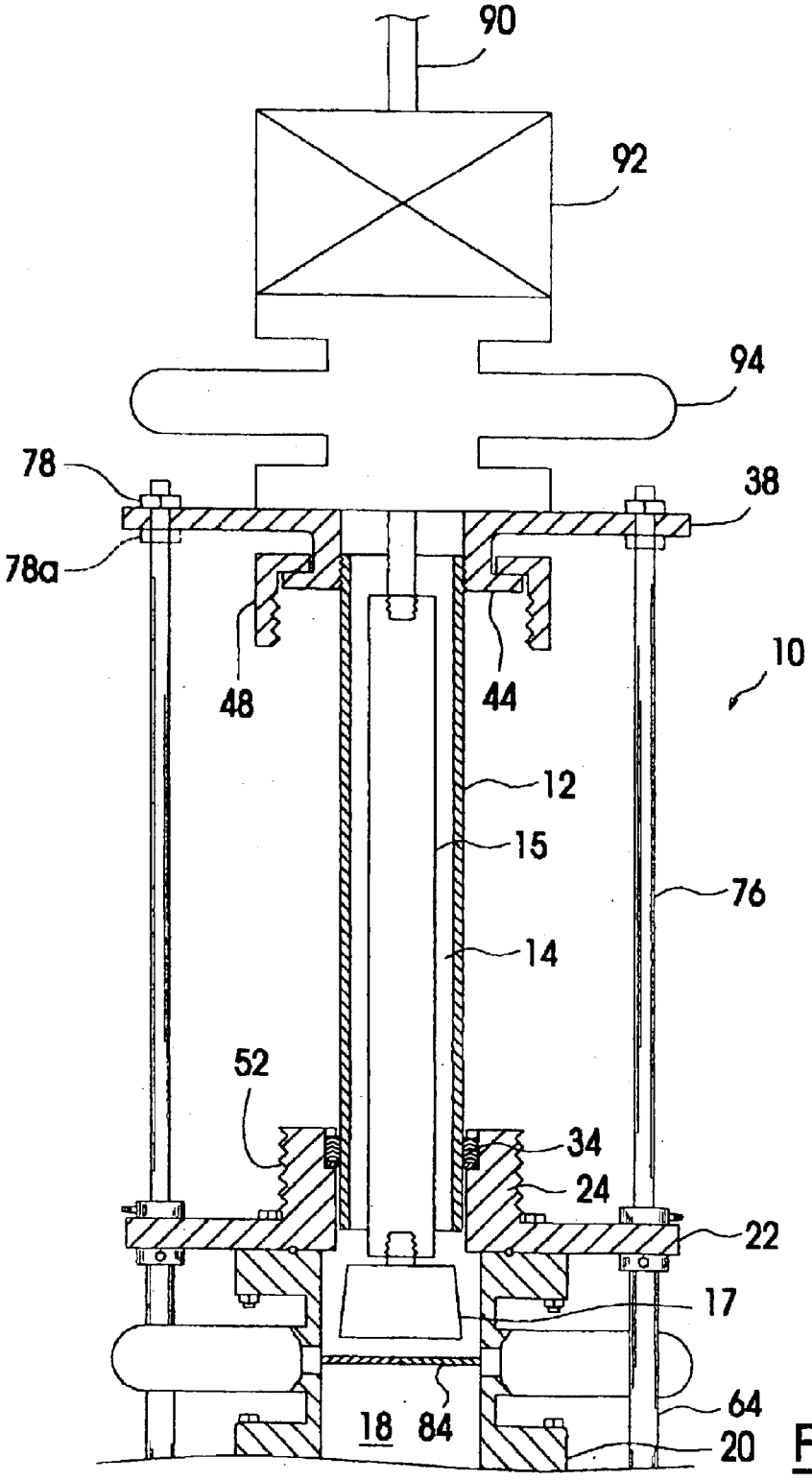
FIG. 5 is a schematic cross-sectional view of a part of a wellhead with the lubricator shown in FIG. 4 mounted thereto, to illustrate one application in which the lubricator is particularly useful, with the lubricator in the first position.

FIG. 5 illustrates another example of a use of the lubricator 10 shown in FIG. 1. In this example, the lubricator 10 is used to insert a drilling motor 15 into the wellbore 18. The drilling motor 15 is used to drive a drill bit 17 detachably secured to the bottom end thereof. The drilling motor 15 with the attached drill bit 17 is detachably secured to a bottom end of a coil tubing string 90, which suspends the drilling motor 15 with the attached drill bit 17 in the wellbore 18. The coil tubing string 90 delivers high-pressure fluid to drive the drilling motor 15. The coil tubing string 90 is injected into or removed from the wellbore 18 by a coil tubing injector 92. The coil tubing injector 92 is mounted on a second blowout preventer (BOP) 94 the tubing rams (not shown) of which seal around the coil tubing string 90 to prevent the pressurized well fluids from escaping from an annulus between the coil tubing string 90 and the second BOP 94. The second BOP 94 is mounted to the top of the lubricator head 38 so that the coil tubing string 90 suspends the drilling motor 15 accommodated in the lubricator tube 12.

The drilling motor 15 can be as long as ten feet, so the lubricator tube 12 should be about the same length as the length of the drilling motor 15, or longer. If the lubricator were a prior art lubricator that could not be inserted into the wellbore, the combination of the second BOP 94 and coil tubing injector 92, which are relatively heavy, would be supported at the top of the lubricator throughout the insertion and drilling process. During the process of inserting the drilling motor 15 with attached drill bit 17 into the wellbore 18, and also during the entire drilling operation, that much weight supported at a top of the lubricator would place considerable strain on the lubricator. This inconvenient and unstable operative condition is avoided when the lubricator 10 in accordance with the invention is used because the lubricator tube 12 is inserted down into the wellhead.

Figure 6:
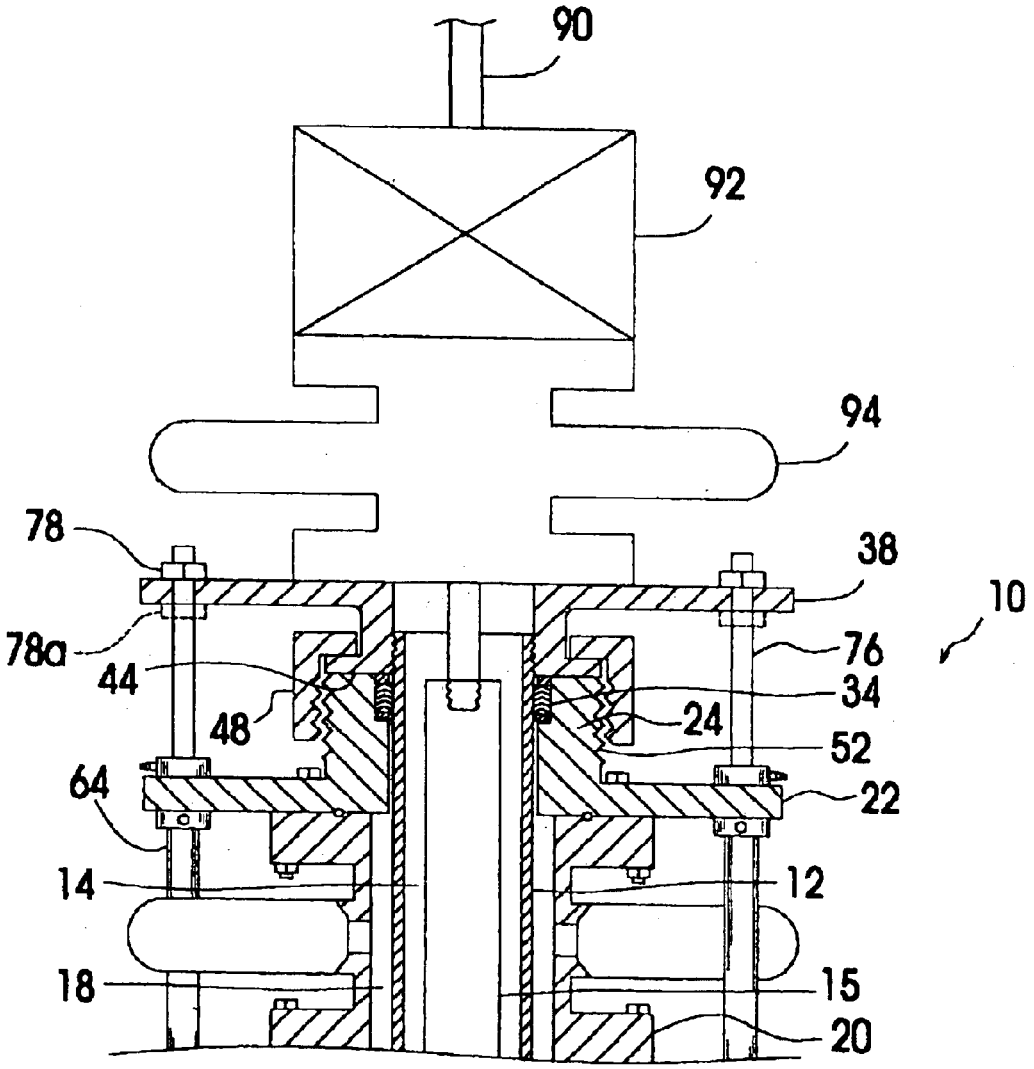
FIG. 6 is a partial cross-sectional view of the lubricator shown in FIG. 5 with the lubricator in the second position.

After the fluid pressure is balanced between the wellbore 18 beneath the closed blind rams 84 of the BOP 20 and the sealed chamber 14 in the lubricator tube 12, the blind rams 84 of BOP 20 are opened for access to the wellbore 18. The hydraulic cylinders 64 are then actuated to move the entire combination of the lubricator tube 12, lubricator head 38, second BOP 94, coil tubing injector 92 with the suspending coil tubing string 90, drilling motor 15 and the attached drill bit 17 downwards until the lubricator tube 12 rests against the bit guide 88 (FIG. 1), or until the bottom flange 44 of the lubricator head 38 rests against a top of the cylindrical throat 24 of the lubricator base 22 and the lockdown nut 48 is securely engaged with the thread 52, as shown in FIG. 6. Thus, the coil tubing injector 92 and the second BOP 94 are supported at a much lower level near the top of the wellhead. This provides safer and more convenient operating conditions, not only during the process of injecting the coil tubing string 90 to lower the drilling motor 15 with attached drill bit 17 into the wellbore 18, but also during the entire drilling operation.

It should be noted that the drill bit 17 attached to the bottom of the drilling motor 15 may have an outer diameter, greater than the inner diameter of the lubricator tube 12, in which case the drill bit 17 cannot be accommodated within the lubricator tube 12, as shown in FIG. 5. Therefore, the procedure for mounting the lubricator 10 to the top of the BOP 20 is different from the procedure described with reference to FIG. 2. In this case the entire lubricator 10, including the lubricator head 38 and lubricator base 22 with the lubricator tube 12, is assembled on the ground or a work platform. The piston rods 76 of the respective hydraulic cylinders 64, which are already attached to the lubricator base 22, are in their extended position and are secured to the lubricator head 38 by means of the connecting nuts 78 and 78*a*. The hydraulic cylinders 64 are preferably hydraulically locked so that relative movement between the lubricator base 22 and the lubricator head 38 is restrained.

The coil tubing injector 92 and the second BOP 94 are also mounted to the top of the lubricator head 38 on the ground, or on a work platform. The coil tubing string 90 is inserted through the coil tubing injector 92 and the second BOP 94 into the lubricator tube 12, and is secured to the top of the drilling motor 15. The drilling motor 15 is inserted through the bottom end of the lubricator tube 12, into the lubricator tube 12 until the drill bit 17, which is secured to the bottom end of the drilling motor 15, is at the bottom end of the lubricator tube 12.

After the entire combination of the lubricator 10, coil tubing injector 92, second BOP 94 and drilling motor 15 together with the attached drill bit 17 and the coil tubing string 90, is hoisted by a drilling rig or a boom truck above the BOP 20, the lubricator 10 is aligned with the BOP 20 and lowered to insert the drill bit 17 into the BOP 20. The lubricator base 22 is then lowered to rest on the top of the BOP 20 and is secured thereto in a fluid tight seal, as shown in FIG. 5.

The subsequent steps of balancing well fluid pressure, opening the BOP 20 and inserting the lubricator tube 12 into the wellbore 18 are as described above with reference to FIGS. 2 and 3, and are not repeated.

The lubricator 10 in accordance with the invention can be used in many other applications. For example, on a drilling rig for fishing tools, on service rigs for drill motors, fishing tools, log tools, etc. The lubricator 10 is particularly advantageous for use with coil tubing, because it lowers and stabilizes the coil tubing injector, and houses fishing tools and drilling motors, wash tools and the like. The lubricator 10 can also be used with a wireline, and lowers the sheave height for the crane being used to support the sheaves. With wireline applications, the lubricator of the present invention can be used for fishing, perforation guns, running in logging tools, recorders, plugs and the like.

Modifications and improvements to the above-described embodiment of the present invention may become apparent to those skilled in the art. The foregoing description is intended to be exemplary rather than limiting. The scope of the invention is therefore intended to be limited solely by the scope of the appended claims.

I claim:

1. A reciprocating lubricator for inserting a downhole tool into a wellbore closed by a pressure containment spool, the lubricator comprising:

a lubricator tube for accommodating the downhole tool;

a lubricator base adapted to be mounted in a fluid-tight seal to a top of the pressure containment spool, the lubricator base including an axial passage sealingly receiving the lubricator tube, which can be reciprocated therethrough;

a lubricator head having an axial passage, the lubricator head being sealingly connected to a top end of the lubricator tube and providing a base for supporting equipment mounted thereto; and a pair of hydraulic cylinders connected to opposite sides of the lubricator base and the lubricator head for reciprocating the lubricator tube and the lubricator head between a first position in which a bottom end of the lubricator tube is positioned above a wellbore closure mechanism of the pressure containment spool, and a second position in which the lubricator tube extends downwards through the pressure containment spool.

2. A reciprocating lubricator as claimed in claim 1 further comprising a lock mechanism for locking the lubricator tube and the lubricator head in the second position.

3. A reciprocating lubricator as claimed in claim 2 wherein the lock mechanism comprises a lock-down nut rotatably connected to a bottom of the lubricator head for threaded engagement with a connector on a top of the lubricator base.

4. A reciprocating lubricator as claimed in claim 3 wherein the lubricator head further comprises a connector on a top thereof for providing a fluid-tight connection to the equipment.

5. A reciprocating lubricator as claimed in claim 1 wherein the lubricator base further comprises a radially recessed region in the axial passage, and a packing received in the radially recessed region for surrounding the lubricator tube to permit the lubricator tube to be reciprocated through the axial passage while inhibiting pressurized well fluid from escaping through an annulus between an inner surface of the axial passage and an outer surface of the lubricator tube.

6. A reciprocating lubricator as claimed in claim 5 wherein the lubricator base further comprises a hollow retainer nut, the hollow retainer nut being releasably secured to the lubricator base, thereby retaining the packing within the radially recessed region.

7. A reciprocating lubricator as claimed in claim 1 wherein each of the hydraulic cylinders is connected to the lubricator base and a piston rod of each cylinder is connected to the lubricator head for reciprocating the lubricator tube and the lubricator head from the first position to the second position.

8. A reciprocating lubricator as claimed in claim 1 wherein the lubricator tube further comprises a pin thread at the top end for releasable engagement with a box thread in the axial passage of the lubricator head.

9. A reciprocating lubricator as claimed in claim 1 wherein the lubricator tube has an outer diameter that is smaller than an inner diameter of a casing of the weilbore, to permit the lubricator tube to be inserted into the casing when the lubricator is moved to the second position.

10. A method for inserting a downhole tool into a live wellbore closed by a nressure containment spool comprising:

mounting a lubricator base in a fluid-tight seal to a top of the pressure containment spool;

assembling a lubricator tube, a lubricator head, the downhole tool and equipment together, the equipment including a closure mechanism to seal a top of the lubricator tube;

hoisting the assembly of the lubricator tube, the lubricator head, the downhole tool and the equipment above the lubricator base;

aligning the lubricator tube with an axial passage through the lubricator base, and lowering the lubricator tube to insert same into the axial passage of the pressure containment spool above the wellbore closure mechanism thereof, a packing seal of the lubricator base surrounding the lubricator tube to inhibit a loss of pressurized well fluids to atmosphere;

connecting respective lubricator injectors to the lubricator head;

opening a weilbore closure mechanism of the pressure containment spool;

inserting the lubricator tube downwards through the pressure containment spool; and manipulating a tool insertion string to lower the downhole tool to a desired position in the wellbore.

11. A method as claimed in claim 10, wherein following the step of mounting, the method further comprises a step of balancing fluid pressure between the wellbore and the lubricator tube prior to opening the wellbore closure mechanism of the pressure containment spool.

12. A method for inserting a downhole tool into a live wellbore closed by a pressure containment spool comprising:

assembling a lubricator tube, a lubricator head, a lubricator base, lubricator injectors, the downhole tool and equipment together, the equipment including a closure mechanism to seal a top of the lubricator tube wherein a bottom section of the lubricator tube is inserted into an axial passage of the lubricator base, surrounded by packing in the lubricator base, and respective lubricator injectors is connected to the lubricator head;

hoisting the assembled lubricator tube, lubricator head, lubricator base, lubricator injectors, downhole tool and equipment above the pressure containment spool;

mounting the lubricator base to a top of the pressure containment spool in a fluid-tight seal, so that the lubricator tube provides the sealed chamber that houses the downhole tool above the pressure containment spool;

opening a wellbore closure mechanism of the pressure containment stool;

inserting the lubricator tube downwards through the pressure containment spool; and manipulating a tool insertion string to lower the downhole tool to a desired position in the wellbore.

13. A method as claimed in claim 12 wherein the step of assembling comprises placing the downhole tool into the lubricator tube through a bottom end thereof after the bottom section of the lubricator tube is inserted through the axial passage of the lubricator base and is surrounded by the packing, so that a part of the downhole tool extends out of the lubricator tube and is contained in the top of the pressure containment spool above the wellbore closure mechanism thereof when the lubricator base is mounted to the top of the pressure containment spool.

14. A method as claimed in claim 12, wherein following the step of mounting, the method further comprises a step of balancing fluid pressure between the wellbore and the lubricator tube prior to opening the wellbore closure mechanism of the pressure containment spool.

15. A reciprocating lubricator for inserting a downhole tool connected to a coil tubing string into a pressurized well bore closed by a pressure containment spool, comprising a lubricator base adapted to be mounted in a fluid-tight seal to a top of the pressure containment spool, the lubricator base including an axial passage sealingly receiving a lubricator tube for accommodating the downhole tool, the lubricator tube being adapted to reciprocate through the lubricator base;

a lubricator head having an axial passage, the lubricator head being sealingly connected to a top end of the lubricator tube and providing a base for supporting a blowout preventer and a coil tubing injector connected to the blowout preventer; and at least two injectors for reciprocating the lubricator tube through the lubricator base, the injectors being respectively connected to the lubricator base and the lubricator head.

* * * * *